US007578239B1

(12) United States Patent
Malek et al.

(10) Patent No.: US 7,578,239 B1
(45) Date of Patent: Aug. 25, 2009

(54) METHODS OF REPLACING RAILWAY HALF TIES

(75) Inventors: Robert A. Malek, Libertyville, IL (US); John W. Gustafson, Trevor, WI (US)

(73) Assignee: Aldridge Electric, Inc., Libertyville, IL (US)

( * ) Notice: Subject to any disclaimer, the term of this patent is extended or adjusted under 35 U.S.C. 154(b) by 0 days.

(21) Appl. No.: 12/239,187

(22) Filed: Sep. 26, 2008

(51) Int. Cl.
*E01B 29/00* (2006.01)

(52) U.S. Cl. ..... 104/9

(58) Field of Classification Search ..... 104/2, 104/4, 6, 7.1, 7.3, 8, 9; 37/446, 447
See application file for complete search history.

(56) References Cited

U.S. PATENT DOCUMENTS 1,595,420 A * 8/1926 Robb ..... 104/12
5,119,723 A * 6/1992 Lovitt, Jr. ..... 104/7.1

* cited by examiner

*Primary Examiner*—Mark T Le
(74) *Attorney, Agent, or Firm*—McDonnell Boehnen Hulbert & Berghoff LLP

(57) ABSTRACT

The invention provides a method of removing half ties from vaults in a railway bed, including detaching a section of rail from one or more of the underlying half ties of the railway bed. A section of rail may be elevated above the railway bed. In the alternate, the half ties may be cut at positions flanking the rail to form sectioned half ties. A tool of a hydraulic hammer is inserted along one of the half ties until the tool approaches a bottom edge of the half tie. The angle of the tool is lowered to a substantially horizontal angle. The tool is advanced substantially horizontally to free the first one of the half ties from the railway bed and the first one of the half ties is then removed.

8 Claims, 16 Drawing Sheets

METHODS OF REPLACING RAILWAY HALF TIES

BACKGROUND OF THE INVENTION (1) Field of the Invention

This invention concerns a machine and methods of repairing railway tracks and, in particular to replacement of a type of crossbeam for railway tracks termed half ties. The invention is particularly related to methods for the extraction or removal of the half ties.

(2) Description of the Art

Common railway track includes two parallel, spaced rails, normally made of iron or steel. The rails are secured to crossbeams, referred to as railway or railroad ties, or sleepers. The ties are typically timber, but concrete or steel ties are also known. Each of the ties individually spans the distance between the two rails and functions to support the rails and maintain the rails at a predefined distance apart. The ties are typically laid on a foundation including a bed of ballast or secured to solid concrete, for example.

Some railway track systems, notably some subway systems, construct the railway somewhat differently. The railway foundation is a pair of parallel concrete ridges, separated by a trough that functions to drain water from the track area. Each of the concrete ridges includes a number of half ties disposed within vaults formed in the concrete ridges. A rail is attached to the half ties on each of the concrete ridges.

It is commonly known that maintenance of railway track includes periodic replacement of damaged, worn or otherwise unsuitable railway elements, and frequently involves the replacement of wooden ties. This is also true for subway systems, where water is frequently present, causing water damage to elements of the railway.

It is a common technique, with respect to conventional railway tracks, to use complex machinery to replace ties in an automated fashion and perform other track maintenance. The machinery that performs these tasks belongs to a class of equipment call "Maintenance Of Way" or MOW equipment. These machines perform many different functions, all related to keeping the track system in good order. They are capable of continuous processes, including changing out the ties, "cleaning" or replacing the railroad ballast, adjusting the track gage (distance between the rails), installing rail clips (the things that attach the rails to the ties), grinding the rail head to a very precise shape, measuring the contour of the rail head with lasers, and many more jobs. They can even continuously replace the rails and ties while riding on the rails they are replacing. The particular machine used to replace ties is a "tie inserter." The tie is unfastened from the rail, the ballast is cleared from around the tie, the machine grabs the old tie at the end, pulls it out to the side, then inserts a new tie and repeats the whole process in reverse order, and then it moves to the next tie and does it again.

Currently, however, there is no efficient method of replacing subway half ties. This is due, at least in part, to the fact that the ties are enclosed, at least partially, in a vault. Thus, typically, half ties are removed by hand with a hand held jackhammer. The operator uses the jackhammer to reduce the half tie into small pieces. The pieces are then removed with a shovel or similar device. In the alternate, a larger piece of equipment, such as a hydraulic hammer, is used to chop the half ties into small enough pieces to permit removal by shovel or the like. A problem with this approach is the time it requires to chop up the ties and then remove the pieces, not to mention the need for several persons manually performing the required tasks.

There is a need for an efficient and effective device and method of replacing half ties. The invention satisfies the need.

SUMMARY OF THE INVENTION

The invention solves one or more of the problems identified above by providing a method of removing half ties from a railway bed, including detaching a section of rail from one or more of the half ties of the railway bed. A section of rail is elevated above the railway bed. A tool of a hydraulic hammer is inserted along one of the half ties until the tool approaches a bottom edge of the half tie. The angle of the tool is lowered to a substantially horizontal angle. The tool is advanced substantially horizontally to free the first one of the half ties from the railway bed and the first one of the half ties is then removed.

In alternate aspects of the invention, the tool may be inserted at a substantially vertical angle before being lowered to a substantially horizontal angle. The tool may be inserted at a substantially vertical angle at an inside edge of the first one of the half ties. The tool may be inserted at a substantially vertical angle at a lengthwise side of a first one of the half ties. The half ties are preferably disposed within a vault within the bed. Each of the vaults may be open to an inside of the railway bed. Each of the vaults may be open to both an inside and an outside of the railway bed. The tool is preferably a chisel.

DETAILED DESCRIPTION OF THE INVENTION

Figure 1:
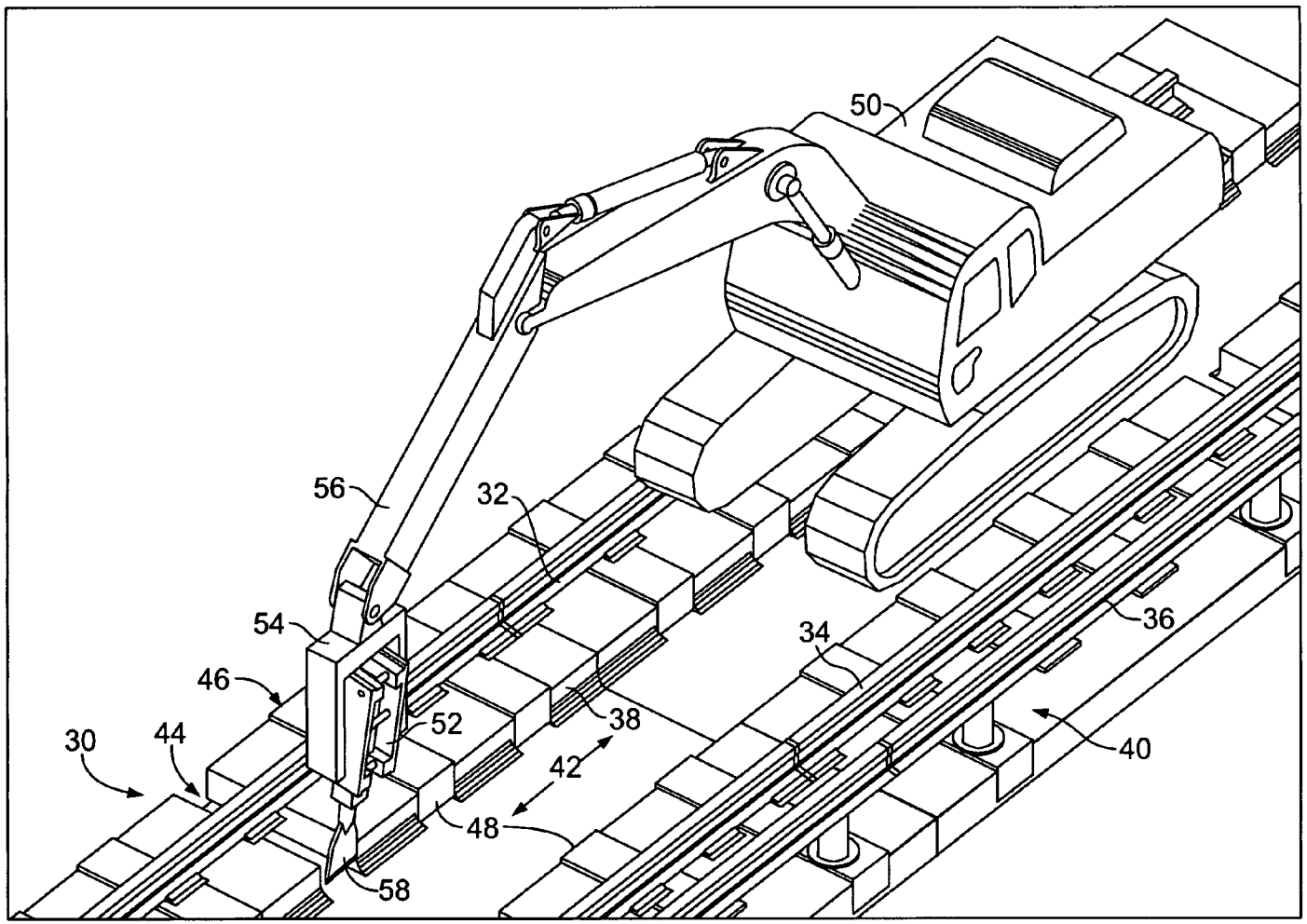
FIG. 1 is a schematic view of part of a hydraulic hammer machine for the removal of half ties.

FIG. 1 shows a railway or railway bed 30 and a conventional excavator 50 with a hydraulic hammer/breaker 52 attached thereto. It will be understood that the railway shown is for illustration purposes, and the invention may be used in other versions of railways that include half ties. The excavator and breaker mechanism 50/52 is a well-known combination of mechanical elements, typically used in breaking up roadways, sidewalks, rock formations, and many other similar uses. The breaker 52 includes a tool attachment 58, which may preferably be a chisel or similar device.

The present invention includes a novel, inverted U-shaped carriage 54, which holds the breaker 52 to an arm 56 of the excavator 50 and permits pivoting of the breaker to orient the breaker to act in a standard orientation and, in addition a horizontal direction. It will be understood that the assembly and operation of such a carriage 54 will be easily undertaken by one of skill in the art.

Returning to FIG. 1, the railway 30, which is constructed as a railway typically used in a subway system, has a first rail 32 spaced from a second rail 34. In a subway employing electrically powered cars, the railway 30 may have a third rail 36 for supplying electricity to the cars.

The first rail 32 is positioned on a first concrete ridge 38. The second rail 34 is positioned on a second concrete ridge 40, spaced from and parallel to the first ridge 38. A trough or drain 42 is formed as a depression between or at a lower elevation than the first and second ridges 38, 40. The drain 42 collects and drains water from the railway 30.

Each ridge 38, 40 includes a number of spaced grooves or vaults 44, having a longitudinal axis transverse to the railway 30. In one embodiment, each vault 44 is open only to the drain 42, or, in other words facing the center or inside of the railway 30, at an inner opening thereof and another embodiment, each vault 44 is open to the drain 42 and, in addition, is open to the outside of the railway 30. The vaults 44 can be only partially open at the drain side of each vault.

Each vault 44 has a half tie 46 disposed in the vault. Each half tie 46 has an inner end 48, which in the embodiment shown is entirely or partially exposed because the vault 44 is open, at least partially, to the drain 42.

Figure 2:
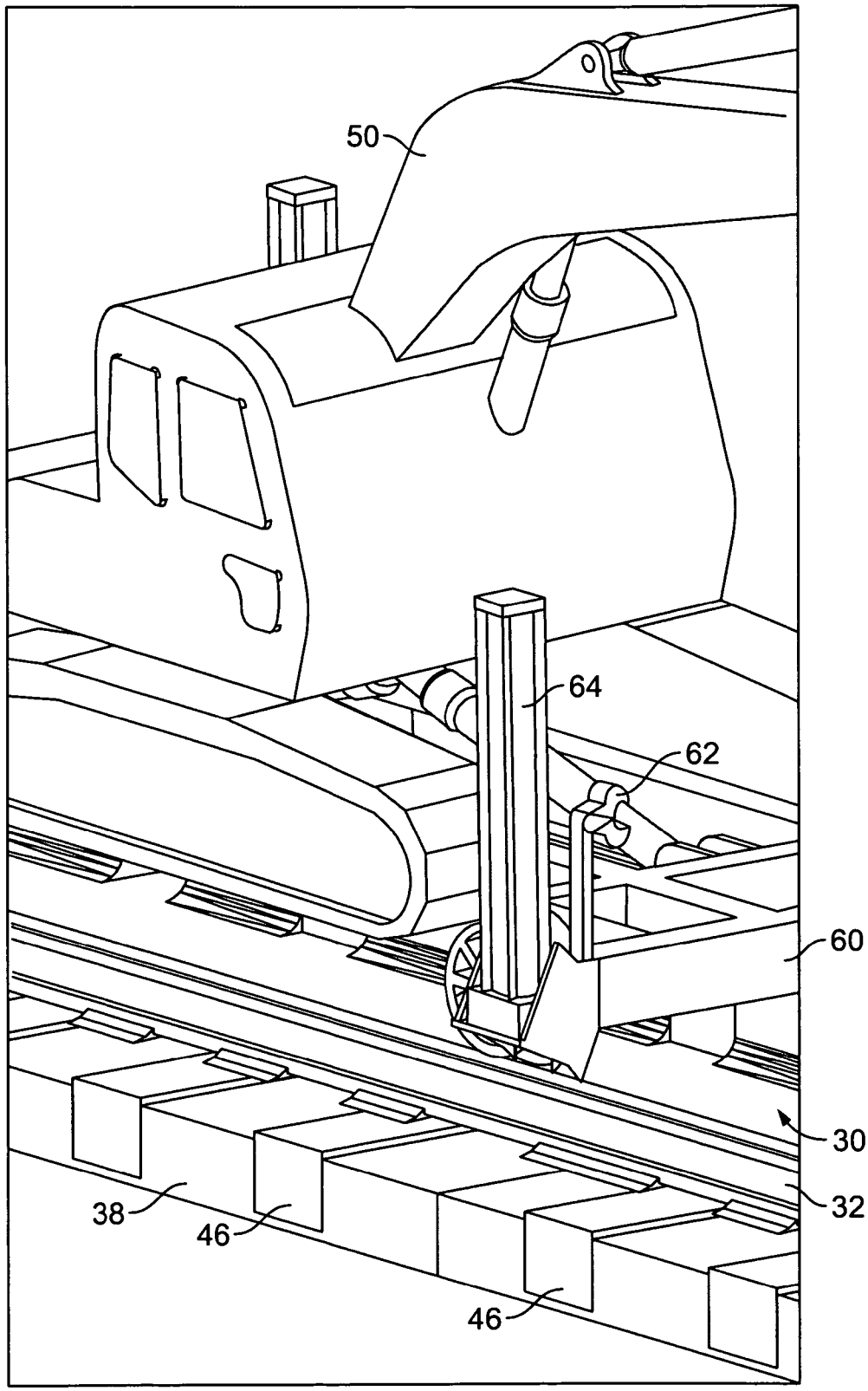
FIG. 2 is a schematic view of the hydraulic hammer of FIG. 1, in an unlocked condition.

Turning to FIG. 2, the excavator 50 is mounted to a framework 60, which permits it to be moved along the railway 30 on the railway tracks. The framework 60 includes a plurality of clamps 62, similar to other railway maintenance machinery. In addition, the with framework 60 includes a plurality of lifting jacks 64, which permit raising and lowering of the framework and any equipment disposed thereon. The clamps 62 are used to secure the framework 60 to the rails or tracks 32, 34 (See FIG. 1) of the railway 30. The lifting jacks 64 are used to lift the framework 60 and a section of track 32, 34 of the railway 30 relative to a section of underlying railway bed when the clamps 62 are attached to the track. In this way the underlying railway bed and ties can have maintenance performed thereupon. It will be understood that the framework 60, clamps 62 and lifting jacks 64 are constructed and operated similarly to well-known and conventional railway maintenance equipment.

Figure 3:
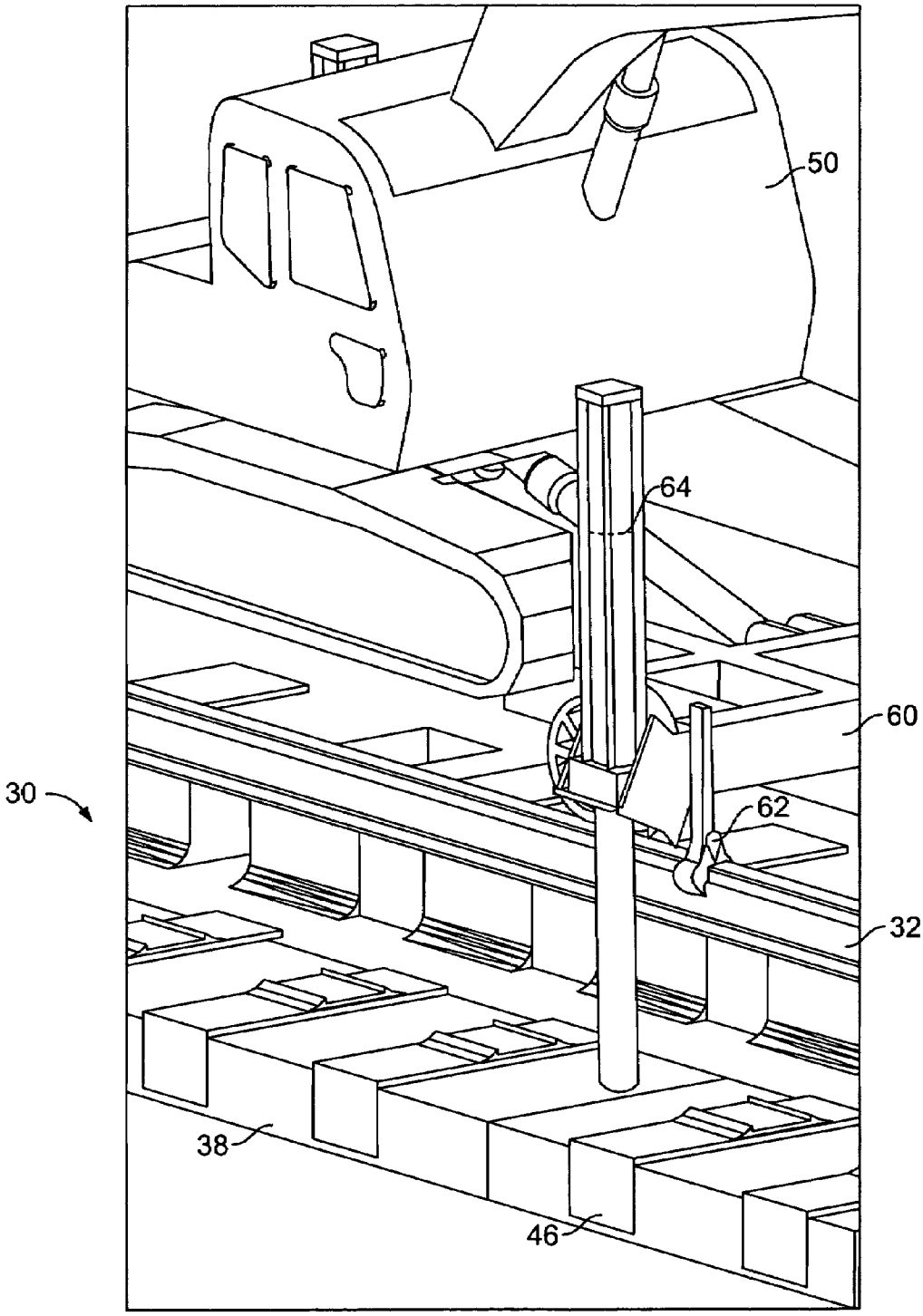
FIG. 3 is a schematic view of the hydraulic hammer of FIG. 1, in a locked condition with rails raised.

Turning to FIG. 3, the excavator 50 and framework 60 are lifted by way of operation of the jacks 64, after the clamps 62 are secured to rails 32, 34 of the railway 30. This occurs, of course, after the tracks (first rail 32 is shown) are released from a section of half ties 46. Lifting the rails 32, 34 from the railway 30, and including equipment attached to equipment framework 60, makes it possible to access the underlying half ties 46 and perform maintenance of the underlying railway bed (first concrete ridge 38 is shown).

Figure 4:
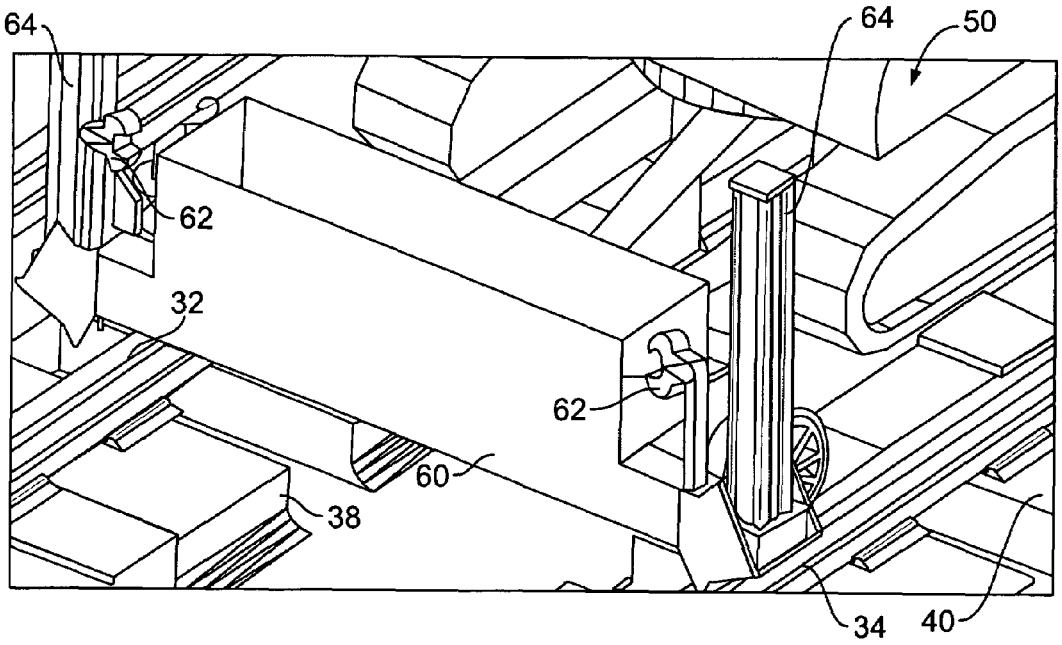
FIG. 4 is a rear schematic view of part of the hydraulic hammer of FIG. 1.

Turning to FIG. 4, excavator 50 and framework 60 are in a lowered position atop the rails 32, 34. The clamps 62 are shown in an undeployed position and the jacks 64 are in a retracted position and not in contact with the track bed ridges 38, 40. This figure illustrates an embodiment of the rear portion of framework 60 and associated machinery.

Figure 5:
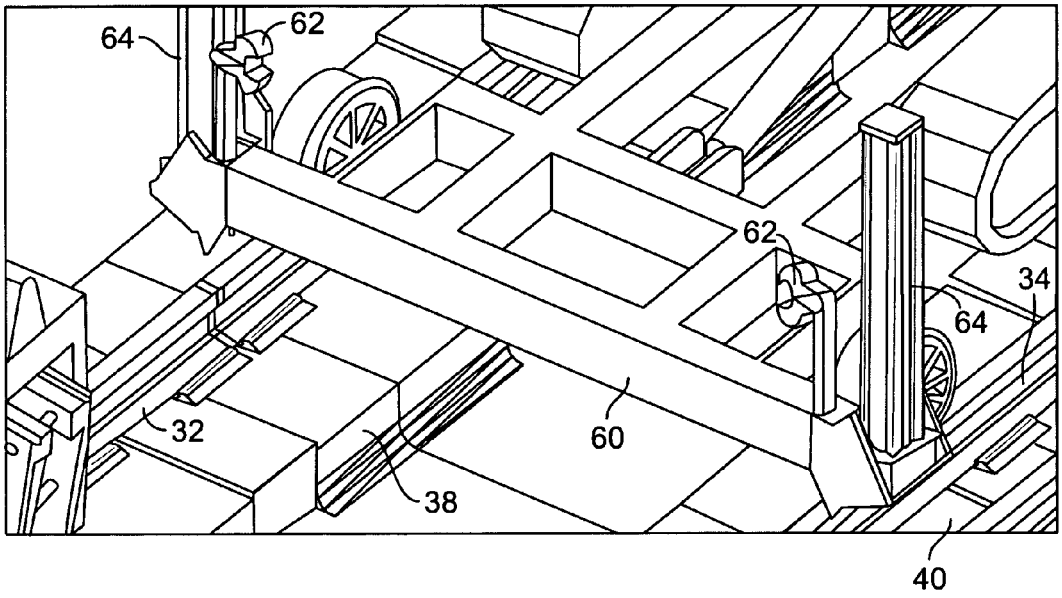
FIG. 5 is a front schematic view of part of the hydraulic hammer of FIG. 1.

Turning to FIG. 5, an embodiment of the front portion of framework 60 and associated machinery is shown. Specifically, framework 60 is shown in a lowered position atop the rails 32, 34. The clamps 62 are in an undeployed position and jacks 64 are in a retracted position and not in contact with the track bed ridges 38, 40.

Figure 6:
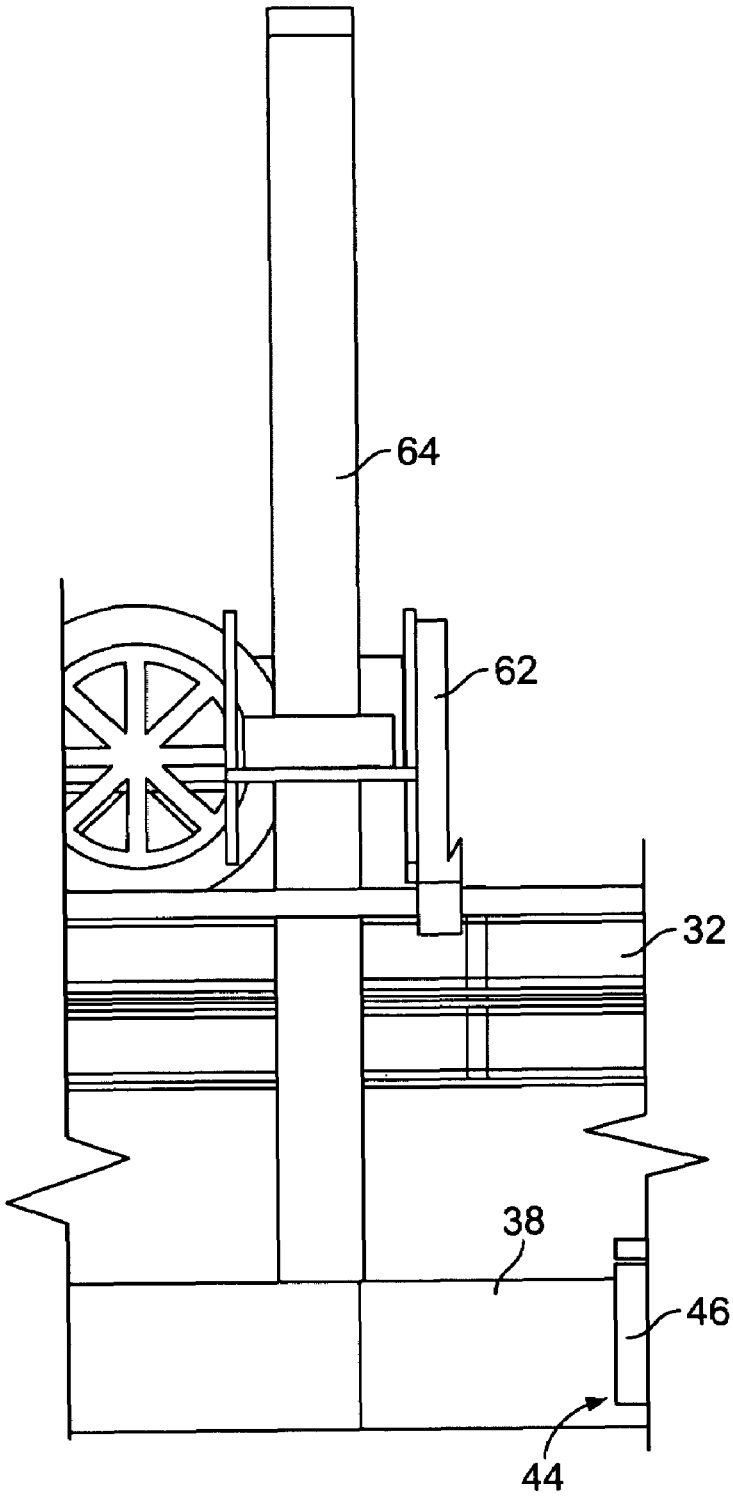
FIG. 6 is a side view of part of the hydraulic hammer of FIG. 1, in a locked condition with rails raised.

Turning to FIG. 6, a side view is illustrated of rail 32 being raised from its position above the first concrete ridge 38. A first part of the process of performing maintenance of the railway, and specifically, of removing the half ties, involves clamping rail 32 with clamp 62. It will be understood that clamps 62 are provided about the framework 60 at positions above the tracks of the railway. The jacks 64 are then activated, which raises the rails up off of the concrete ridges. FIG. 6 illustrates the excavator 50 and framework 60 in a condition whereby maintenance work can commence and the ties 46 can be accessed and extracted from the vaults 44.

Figure 7:
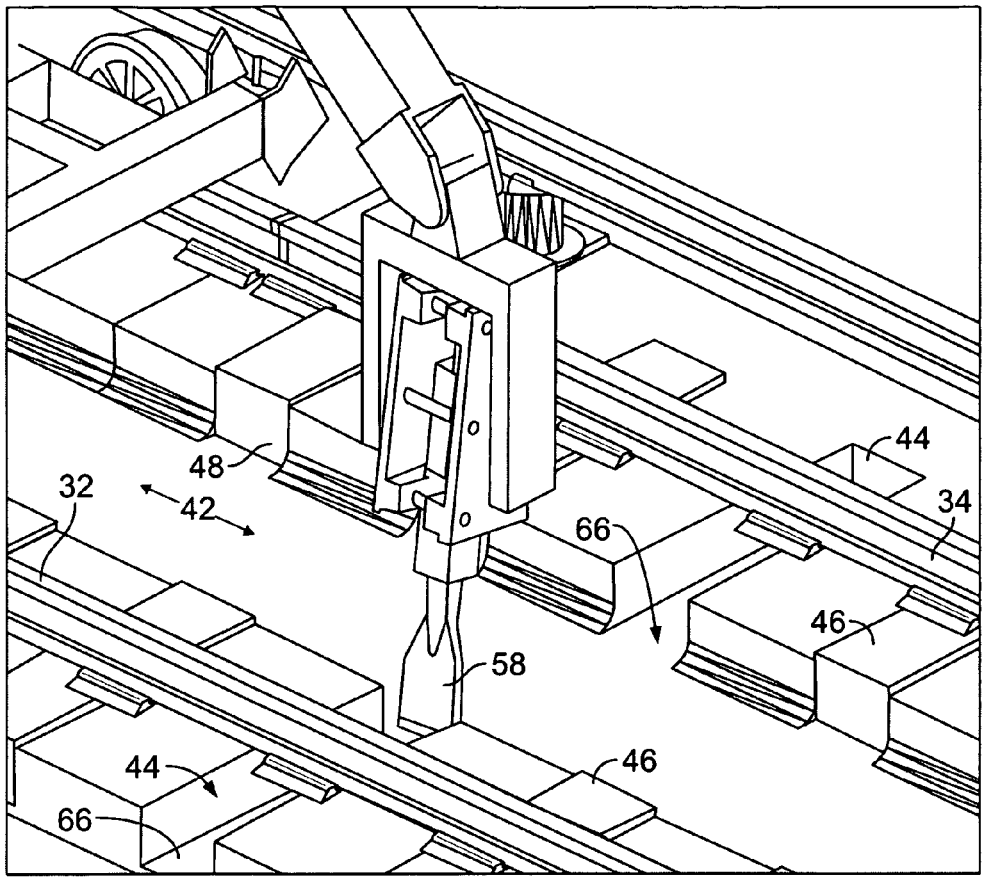
FIG. 7 is a schematic view of a hydraulic hammer in a side approach vertical start position.
Figure 8:
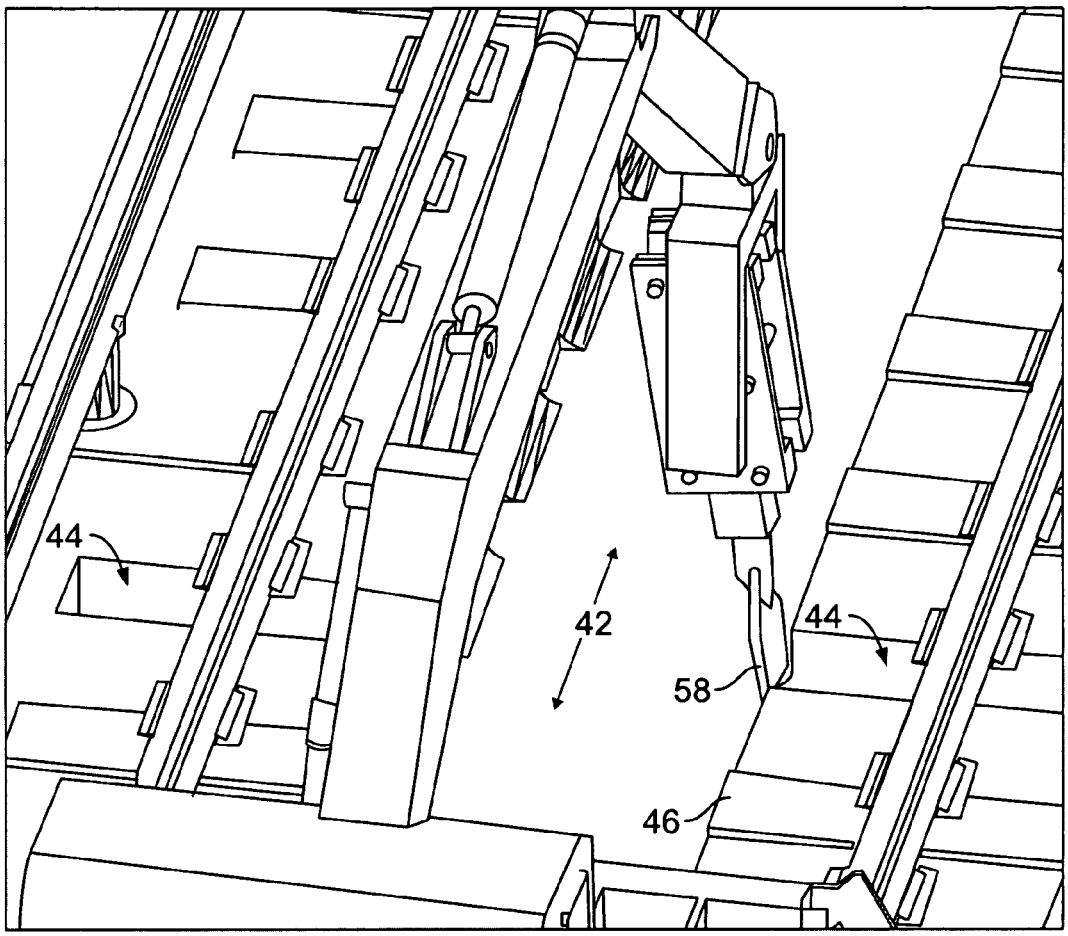
FIG. 8 is another schematic view of a hydraulic hammer in a side approach vertical start position.

FIGS. 7 and 8 illustrate the hydraulic hammer 52 and tool 58 in an embodiment of a start position for removal of half ties 46. The embodiment of the step illustrated can be referred to as a side start position. In the illustration, the half tie 46 is removed from the vault 44 for clarity.

In a side start position the chisel tool 58 initially is in a substantially vertical orientation, and is positioned at the end of the vault 44 adjacent the drain 42. In other words, the tool 58 is angled substantially downwardly at the inner end 48 of the tie 46. The procedure includes advancing the tool 58 downwardly adjacent the inner end 48 of the tie 46 until it reaches a position at or near the bottom or floor 66 of the vault 44. It will be understood, for purposes of describing this invention that substantially vertical or substantially vertical orientation includes any angle ranging from about strictly vertical or ninety degrees to about a forty-five degree angle relative to the ground. After the tool 58 is positioned adjacent the vault 44 from which a tie 46 is to be extracted, the first and second rails 32, 34 are raised above the first concrete ridge 38 in the second concrete ridge 40. In an alternate embodiment, the first and second rails 32, 34 can be raised before the tool 58 is positioned in the positioned illustrated.

Figure 9:
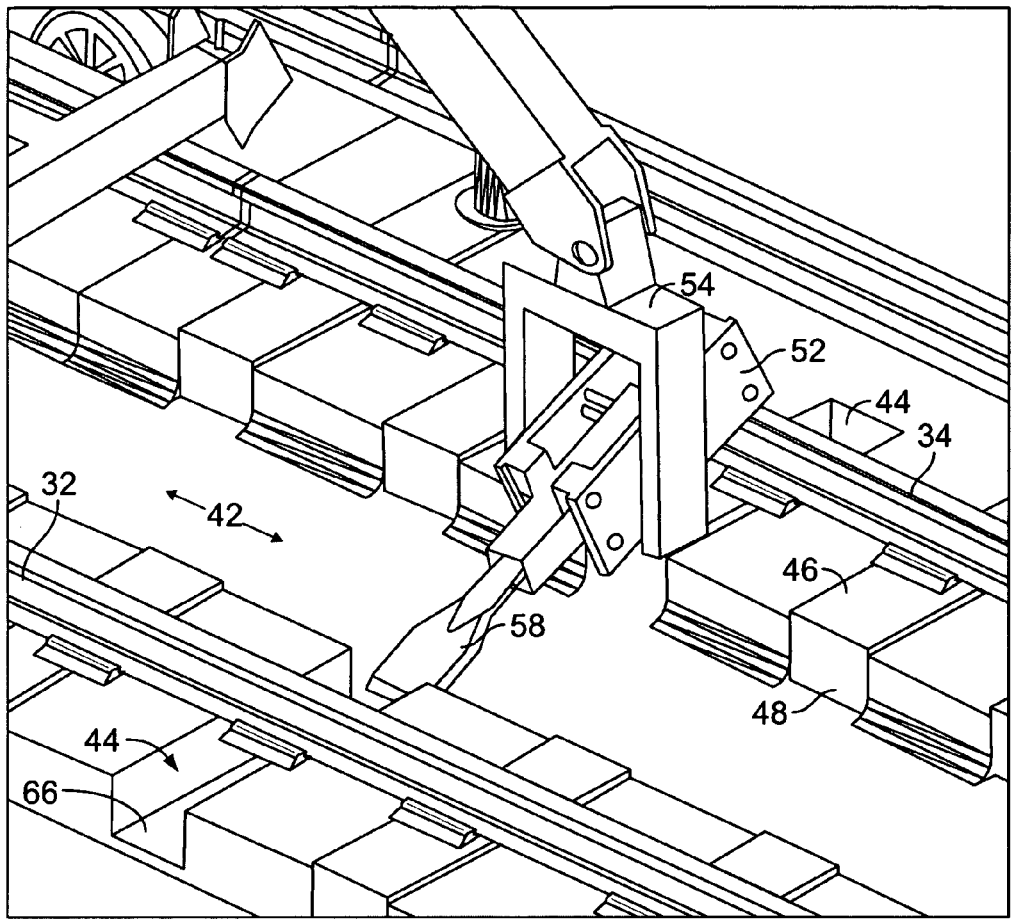
FIG. 9 is a schematic view of a hydraulic hammer during a side approach removal process.
Figure 10:
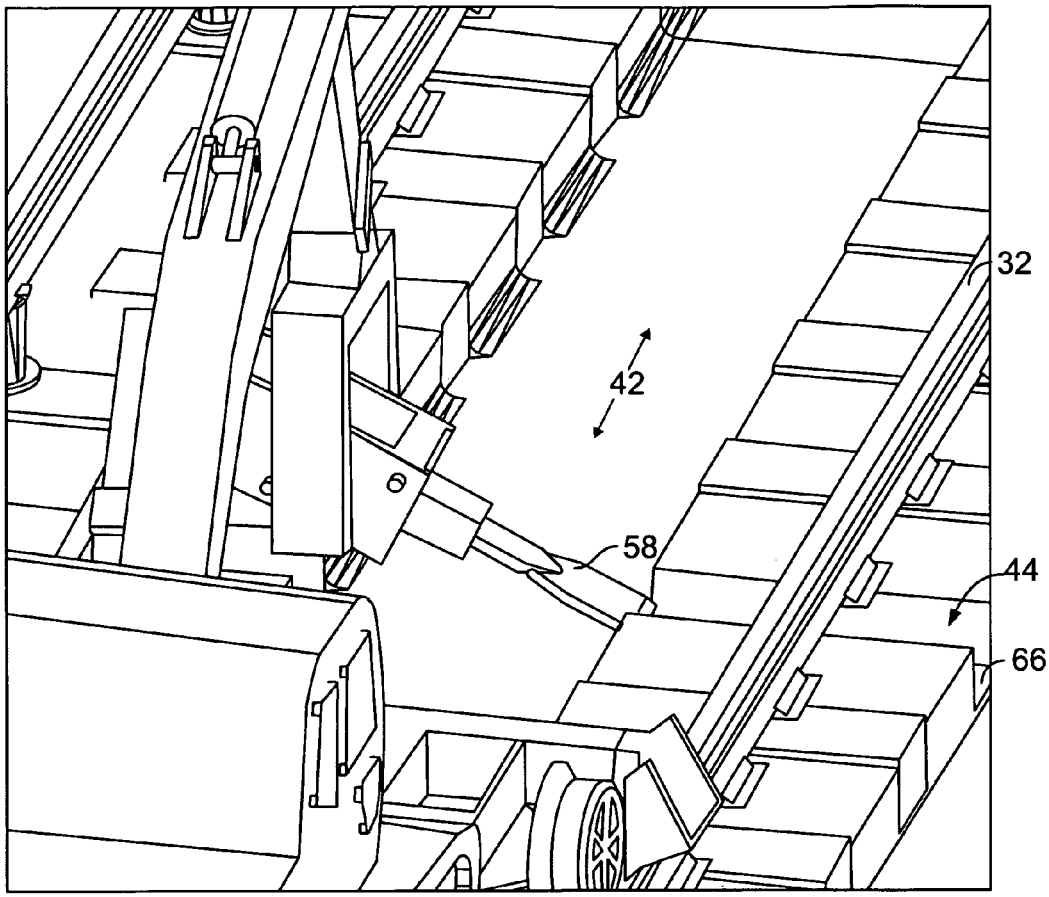
FIG. 10 is another schematic view of a hydraulic hammer during a side approach removal process.

FIG. 9 illustrates the orientation of the hydraulic hammer 52 and tool 58 after the above start position and subsequent vertical advancement of the tool has been completed. In this step, the tool has reached near or to the bottom 66 of the vault 44 and the carriage 54 has positioned the hydraulic hammer 52 and tool 58 to a more horizontal angle. For purposes of this invention, horizontal position will be understood to include angles that are strictly horizontal, in other words parallel to the plane of the ground, and including positions up to about forty-five degrees relative to horizontal. FIG. 10 shows another view of the step shown in FIG. 9, with jacks and clamps not omitted for clarity.

After the tool 58 has reached a position at or near the vault bottom 66, the tool is repositioned to a horizontal angle and advanced along the axis of the vault so as to lever and or push the half tie 46 from the vault. This can occur as the half tie 46 is pushed out of the vault away from the trough 42, in an embodiment where the vault is open ended at both ends, or as the half tie is forced up and out of the vault, in an embodiment where the vault is closed at an end away from the trough. After being forced from the vault 44 by the advancement of the tool 58, the tie 46 can easily be removed and replaced.

Figure 11:
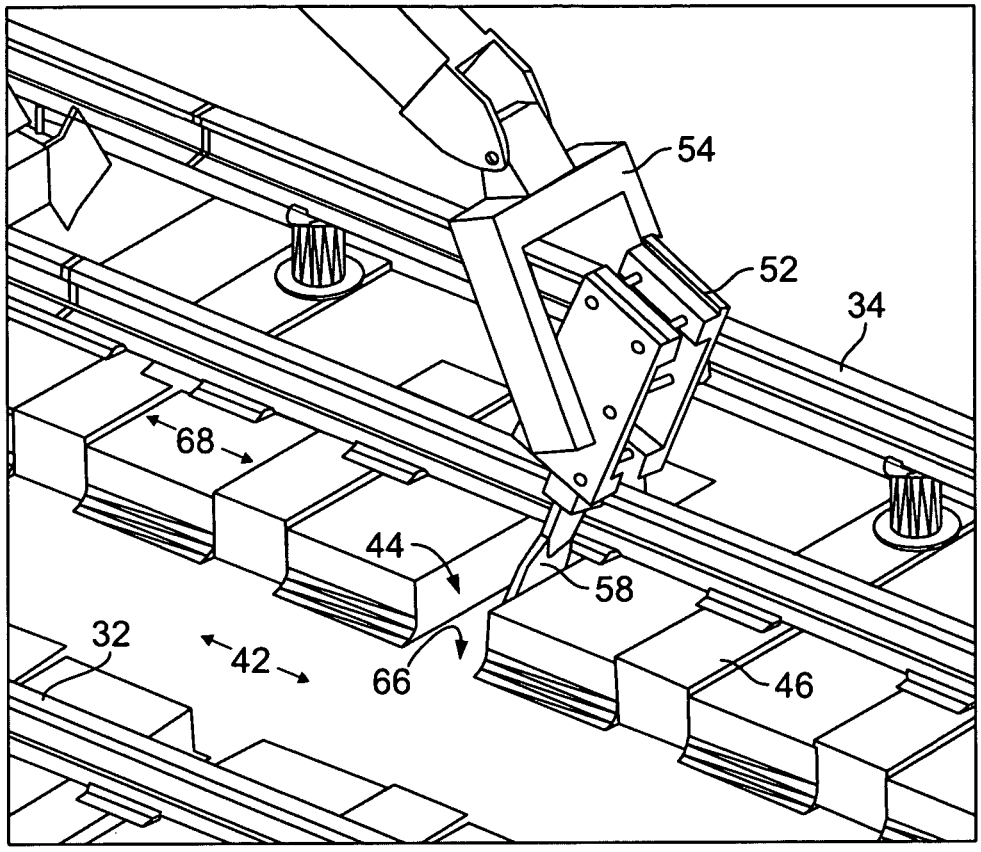
FIG. 11 is a schematic view of a hydraulic hammer during a top approach removal process.
Figure 12:
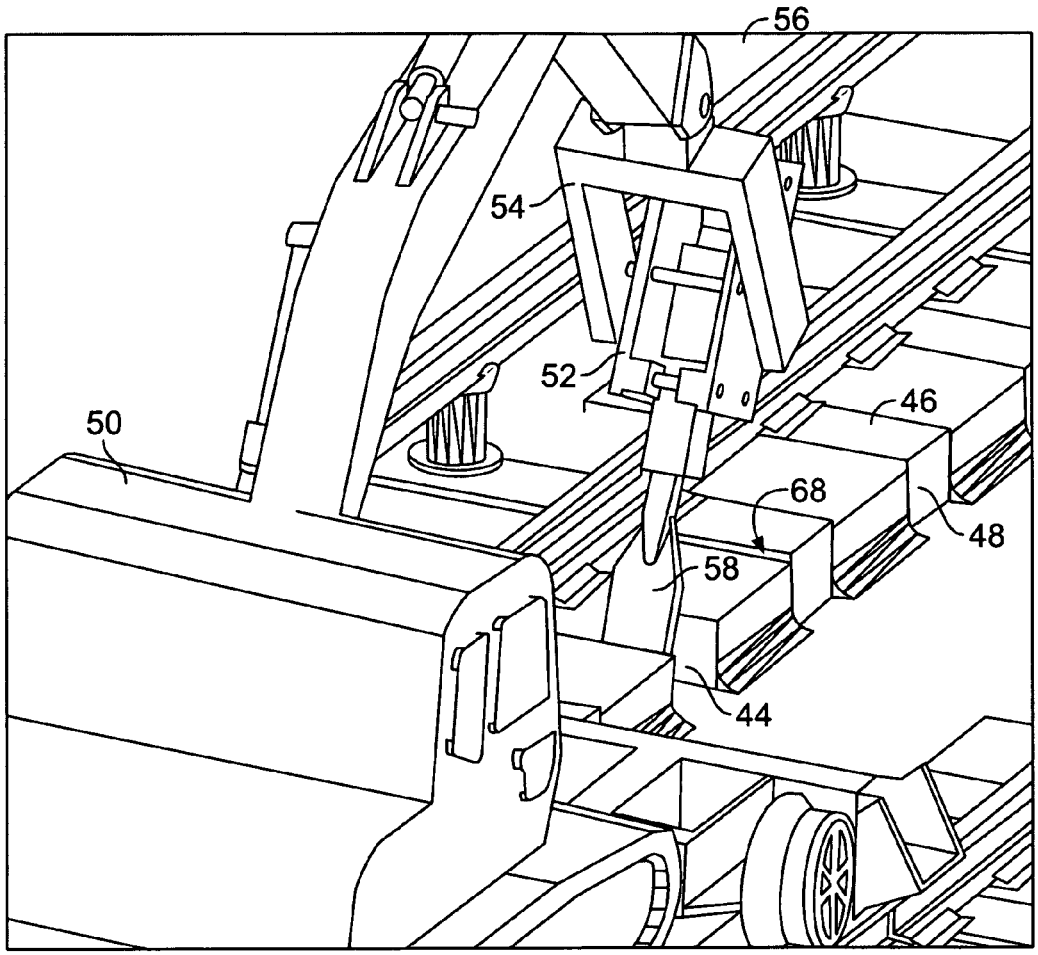
FIG. 12 is another schematic view of a hydraulic hammer during a top approach removal process.

FIGS. 11 and 12 illustrate another method of removing half ties 46. As in the above method, the rails 32, 34 are disconnected from the ties 46, and the rails are lifted above the railway to provide access to the ties. The excavator 50 uses arm 56 to insert the tool 58 along one of the lengthwise sides 68 of vault 44 in a vertical direction, instead of at the inner end 48 of the half tie 46 as in the previously described method. After the tool 58 has been inserted and reached the vault bottom 66 or a depth near the bottom of the vault 44, the carriage 54 lowers the angle of the breaker 52 and tool 58 to a more horizontal position, which levers the half tie 46 from the vault. After being forced from the vault 44, by the advancement of the tool 58, the tie 46 can easily and quickly removed and replaced.

FIGS. 13-16 show a device and an alternate embodiment of decoupling the rails—one of which is shown in FIGS. 13-16, for example rail 32—from an underlying half tie 46 (see FIG. 13), and enabling removal of the half tie. The present method is especially useful in railway areas where lifting the rail to extract the underlying half ties is not practical or possible, such as, for example, at crossovers and adjacent sidings.

In the previously described methods, the rail is unfastened from the underlying half ties in a standard fashion. In general, fasteners, for example screw spikes, driven spikes or clips, are removed from tie plates fastened to the half ties that are functioning to hold the rail in position. After the rails are decoupled from the tie plates and the tie plates freed from the half ties, the rail can be lifted and the underlying half ties can be extracted according to the inventive method. In the embodiment described herein, the tie plates are unfastened and removed as described above, and then the half ties are sectioned before removal as will be described in more detail below.

Returning to FIGS. 13-16, before removal of the half ties 46 from vault 44, the tie plates (not shown) are unfastened and removed. Two cuts are made vertically in positions closely flanking the rail 32 through or nearly through the half tie 46. Vertically, in this instance, will be understood to mean a direction extending from the top of the half tie to a position approaching or reaching the bottom of the half tie.

The cuts are made by a device which includes a modified chain saw, which will be referred to a tie cutter 70. The tie cutter 70 includes a frame 72 which holds a chain saw with a generally rectangular chain saw bar 74. Because the saw bar 74 is rectangular, the tie saw 70 can section a rectangular half tie with vertical plunge cuts.

The tie saw 70 is attached to a rail 32, by attaching clamps 76 to the rail. A plunge cut is made by plunging the saw vertically along a first flank of the rail. The tie saw 70 is unclamped from the rail 32 and rotated so that the chain saw bar 74 is positioned on the other flank of the rail, and a plunge cut is made vertically along the second flank. Thus, the half tie 46 is sectioned into three parts, with a narrow central section directly underlying the rail 32. Since the rail 32 is not lifted, it is easy to remove that sectioned central portion of the half tie 46 after removing at least one of the other two sections. After cutting the half tie 46 into sections, the sections are removed as shown in FIGS. 11 and 12 and described above.

Figure 13:
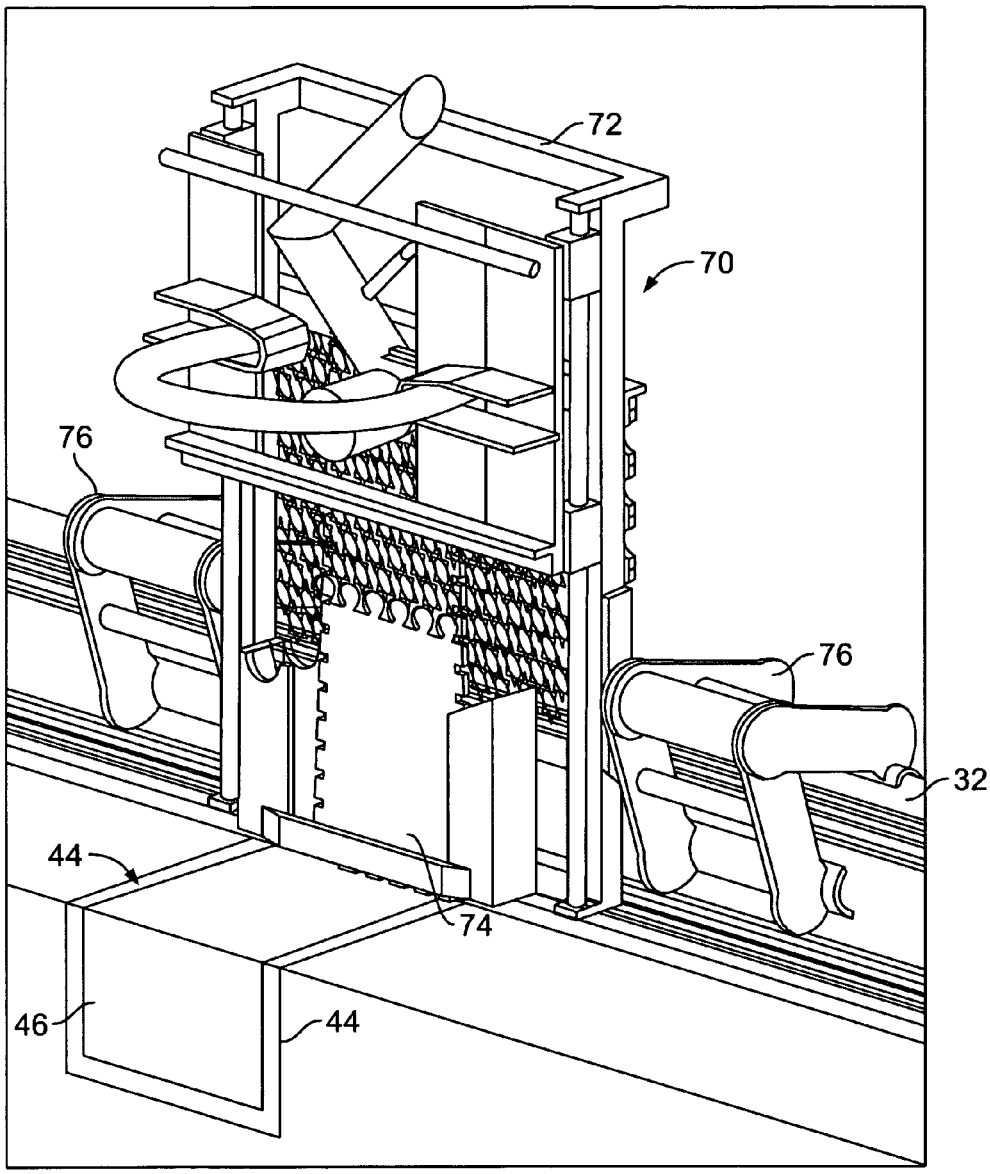
FIG. 13 is a schematic view of a tie cutter attached to a rail and with the cutter in a retracted position alongside a near side of the rail.
Figure 14:
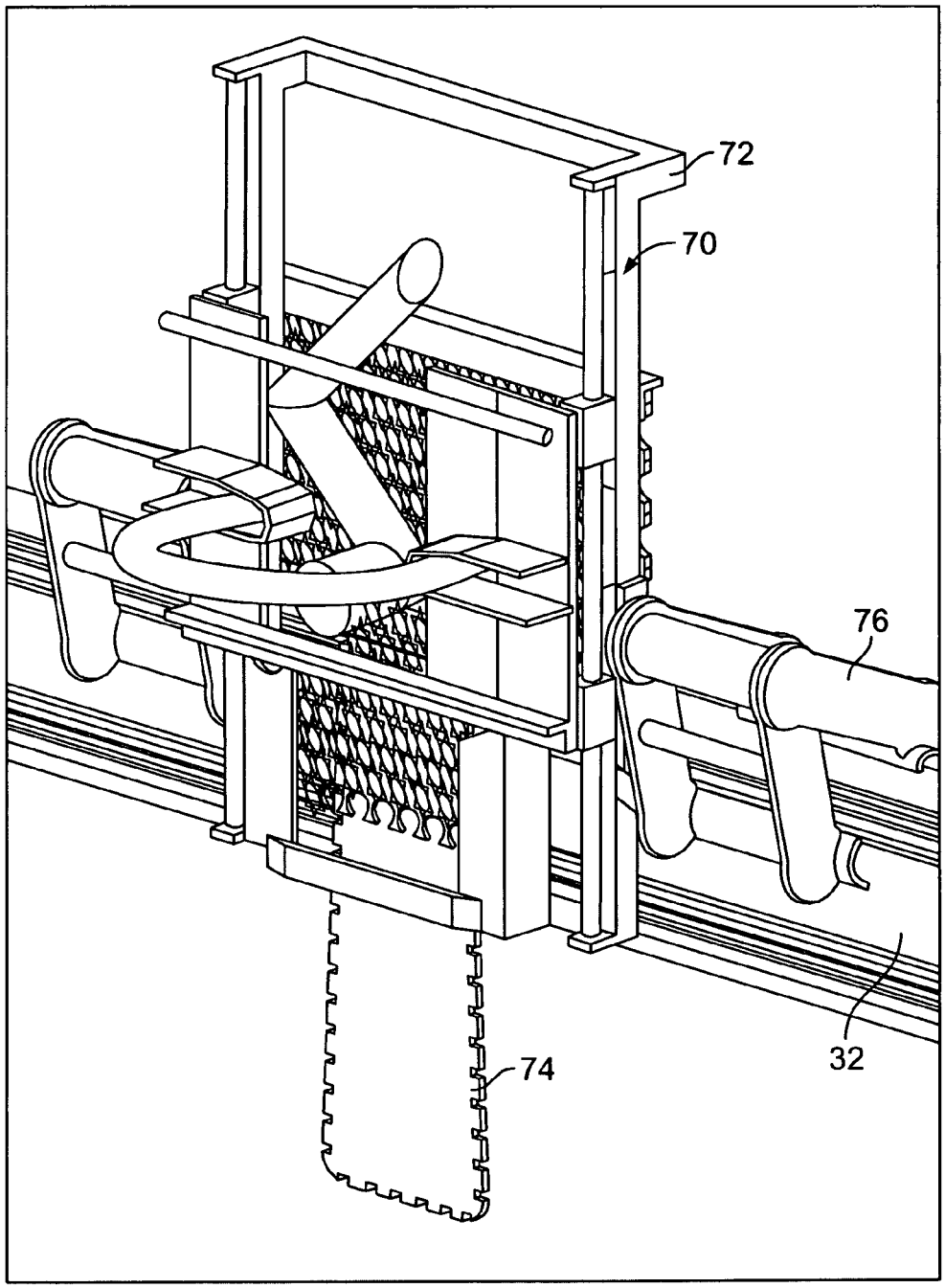
FIG. 14 is a schematic view of a tie cutter attached to a rail and with the cutter in an extended position alongside a near side of the rail.
Figure 15:
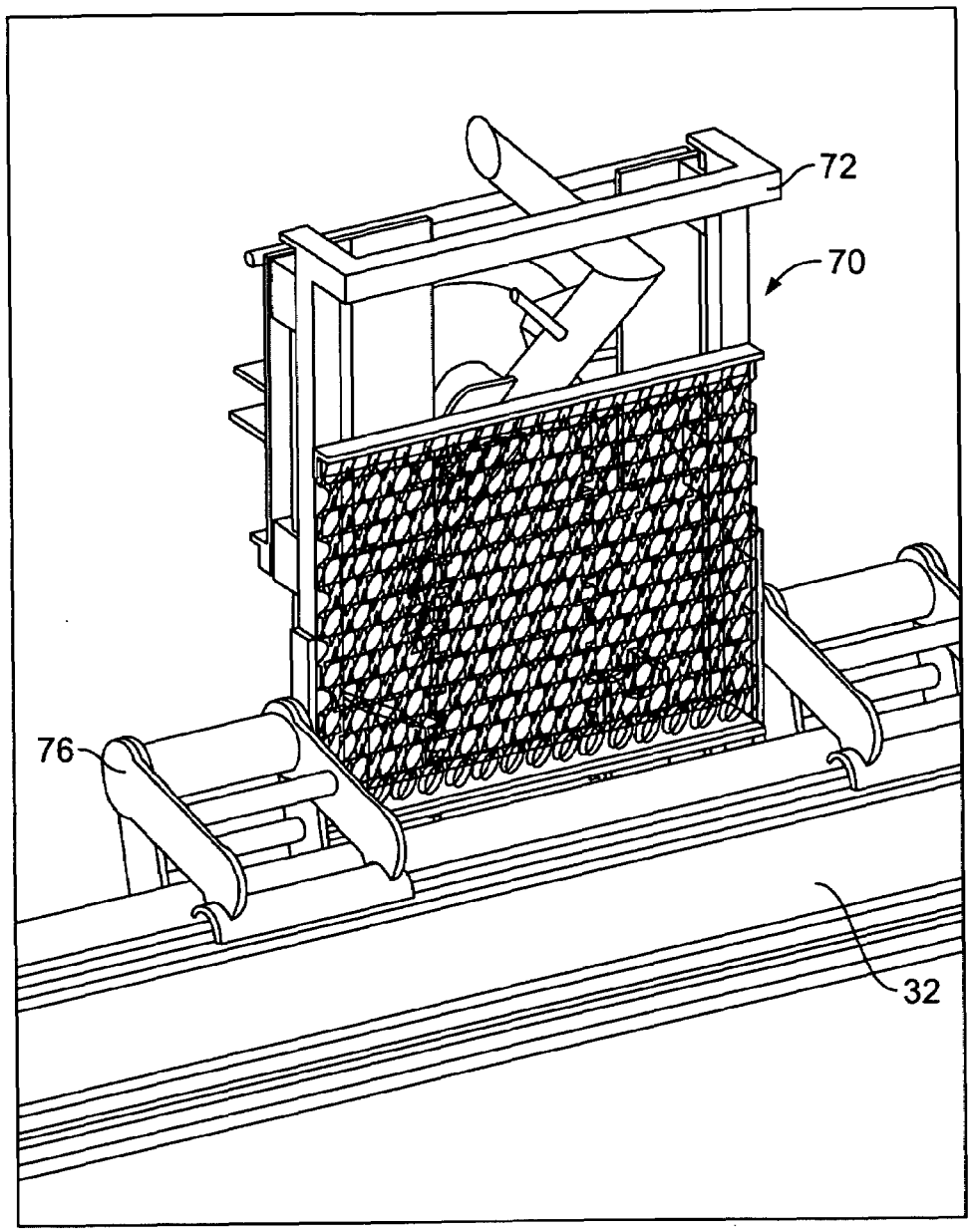
FIG. 15 is a schematic view of a tie cutter attached to a rail and with the cutter in a retracted position alongside a far side of the rail.
Figure 16:
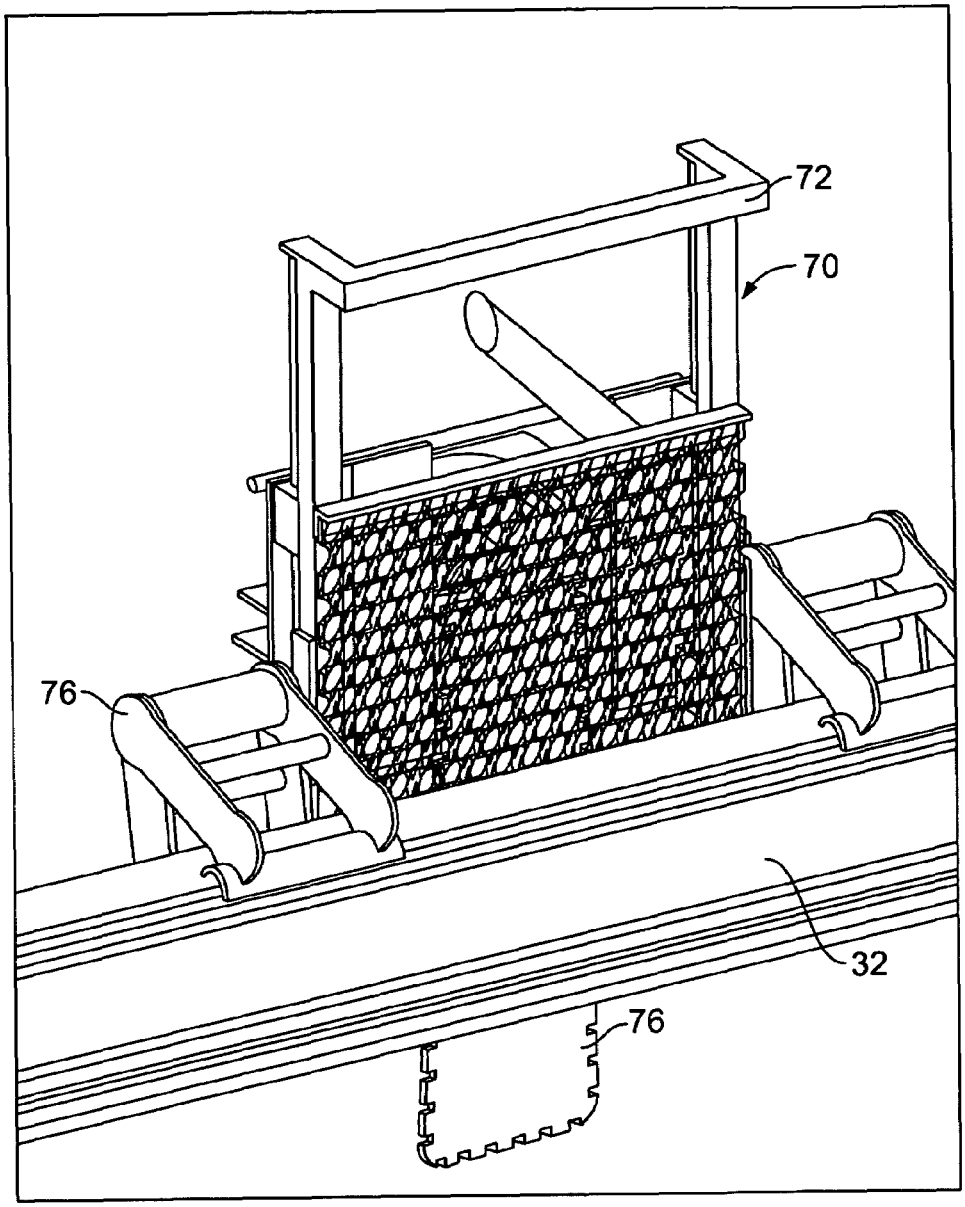
FIG. 16 is a schematic view of a tie cutter attached to a rail and with the cutter in an extended position alongside a far side of the rail.

FIG. 13 shows the frame 70 attached to rail 32 by clamps 76 and the saw bar 74 in a retracted position. FIG. 14 shows the frame 70 of the tie saw 70 attached to rail 32 by clamps 76 and the saw bar 74 is in an extended position. FIGS. 13 and 14 show the tie saw 70 in a position to perform a plunge cut on a first flank or side of rail 32. FIGS. 15 and 16 show the tie saw 70 in a position to perform a plunge cut on a second or opposite flank or side of rail 32.

To those skilled in the art to which this invention pertains, the above-described preferred embodiment may be subject to change or modification. Such change or modification can be carried out without departing from the scope of the invention, which is intended to be limited only by the scope of the appended claims.

The invention claimed is:

1. A method of removing a half tie from a vault of a railway bed, comprising:

a) detaching a section of rail from the half tie;

b) elevating the section of rail above the half tie;

c) removing the half tie from the vault by inserting a tool at an inner end of the half tie at a first angle, wherein the vault is closed at an outside of the railway bed;

d) lowering the tool from the first angle;

e) advancing the tool in an outward direction until the half tie is freed from the vault; and f) removing the half tie.

2. The method of claim 1, wherein at least steps c-f are repeated to remove a plurality of half ties.

3. The method of claim 1, wherein the tool is inserted at a substantially vertical angle before being lowered to a substantially horizontal angle.

4. The method of claim 1, wherein each of the vaults is open to an inside of the railway bed.

5. The method of claim 1, wherein the tool is a chisel.

6. A method of removing a half tie from a vault of a railway bed, comprising:

detaching a section of rail from the half tie, the half tie disposed within the vault of the railway bed, and wherein the vault is closed to an outside of the railway bed;

sectioning the half tie, while the half tie is positioned in the vault by making at least one cut through the half tie at a position flanking the rail to form a sectioned half tie;

inserting a tool of a hydraulic device at one of an inside edge and an inner end of the half tie until the tool approaches a bottom edge of the half tie;

lowering an angle of the tool to a substantially horizontal angle;

advancing the tool substantially horizontally to free the sectioned half tie from the vault in the railway bed; and removing the sectioned half tie.

7. The method of claim 6, wherein the cuts are vertical plunge cuts.

8. The method of claim 6, wherein said sectioning includes making two cuts at a position flanking each of the sides of the rail to form the sectioned half tie.

* * * * *